US005483941A

United States Patent [19]

Cullen et al.

[11] Patent Number: 5,483,941

[45] Date of Patent: Jan. 16, 1996

[54] METHOD AND APPARATUS FOR MAINTAINING TEMPERATURES DURING ENGINE FUEL CUTOFF MODES

[75] Inventors: Michael J. Cullen; Robert M. Marzonie, both of Northville, Mich.; Joseph N. Ulrey, Hiroshima, Japan; Richard W. Sbaschnig, Dearborn, Mich.; Michael A. Weyburne, Northville, Mich.; Paul C. Mingo, Farmington Hills, Mich.

[73] Assignee: Ford Motor Company, Dearborn, Mich.

[21] Appl. No.: 141,177

[22] Filed: Oct. 25, 1993

[51] Int. Cl.[6] ..... F02D 7/00

[52] U.S. Cl. ..... 123/481

[58] Field of Search ..... 123/481, 333, 123/198 F

[56] References Cited

U.S. PATENT DOCUMENTS

| | | | |
|---|---|---|---|
| 4,023,358 | 5/1977 | Maurer et al. | 60/277 |
| 4,146,006 | 3/1979 | Garabedian | 123/481 |
| 4,172,434 | 10/1979 | Coles | 123/481 |
| 4,256,074 | 5/1981 | Sugasawa et al. | 123/440 |
| 4,337,740 | 7/1982 | Sugasawa et al. | 123/198 |
| 4,391,255 | 7/1983 | Staerzl | 123/481 |
| 4,484,548 | 11/1984 | Sugasawa et al. | 123/198 |
| 4,489,695 | 12/1984 | Kohama et al. | 123/481 |
| 4,509,488 | 4/1985 | Forster et al. | 123/481 |
| 4,541,387 | 9/1985 | Morikawa | 123/481 |
| 4,951,773 | 8/1990 | Poirier et al. | 180/197 |
| 4,991,558 | 2/1991 | Daly et al. | 123/481 |
| 5,038,739 | 8/1991 | Ishii | 123/481 |
| 5,275,143 | 1/1994 | Lembke et al. | 123/481 |
| 5,287,279 | 2/1994 | Anan | 123/481 |

*Primary Examiner*—Thomas N. Moulis

*Attorney, Agent, or Firm*—Peter Abolins; Roger L. May

[57] ABSTRACT

A method, for use with a vehicle including a multi-cylinder internal combustion engine having exhaust valves, for controlling the temperature of the exhaust valves during fuel cutoff modes of engine operation utilizing a bit pattern representation of the engine cylinders. The method includes cutting off the fuel delivered to the cylinders in an indexed cylinder firing pattern to vary which cylinders receive fuel, so as to maintain acceptable exhaust valve temperature levels. The method may also include operating the engine with a lean air/fuel ratio, so as to maintain acceptable catalytic converter temperature levels.

8 Claims, 4 Drawing Sheets

METHOD AND APPARATUS FOR MAINTAINING TEMPERATURES DURING ENGINE FUEL CUTOFF MODES

TECHNICAL FIELD

The present invention relates to a method and apparatus for maintaining acceptable exhaust valve and catalytic converter temperatures during engine fuel cutoff modes of operation.

BACKGROUND ART

There are several modes of vehicle operation wherein it is advantageous to turn off or cut the fuel to specific engine cylinders. Typically, fuel cutoff modes can be initiated upon detection of an engine overspeed condition, upon detection of a vehicle overspeed condition, upon detection of a partial or full ignition system failure on a subset of cylinders, or upon detection of a need for a reduction of engine torque, such as for traction control or anti-wheel-spin control purposes.

As the name suggests, during a fuel cutoff mode of operation, fuel is no longer supplied to one or more engine combustion cylinders. Fresh air, however, continues to flow through the cylinders. A problem results when the remaining fueled cylinders are calibrated to run richer-than stoichiometric air/fuel ratio and the engine exhaust temperatures are at or near the design limit for high temperature. In this situation, the fresh air of the deactivated cylinders meets the unburned fuel products of the rich firing cylinders in the catalytic converter. During this interaction, the excess fuel can burn in the presence of the catalyst, causing potentially damaging temperatures.

One way to limit this over-temperature problem is to run the firing cylinders with an air/fuel ratio that is leaner than the stoichiometric ratio, so as to reduce the quantity of unburned fuel products in the catalytic converter. For example, U.S. Pat. No. 4,951,773, issued to Poirier et al., discloses a traction control system fuel control utilizing an air/fuel enleanment strategy. Poirier et al. teaches expressing the enleanment as an adder to the normal air/fuel schedule. Other cylinder cutout strategies are disclosed in U.S. Pat. Nos. 4,489,695 issued to Kohama et al., 4,509,488 issued to Forster et al., and 5,154,151 issued to Bradshaw et al. The problem with these strategies, however, is that the engine exhaust valves have a peak temperature tolerance of around 1650° F., and this temperature can be exceeded with a lean air/fuel during engine operation at high speed/loads.

There is, therefore, a need to develop a strategy to maintain temperatures of the exhaust valves, as well as the catalytic converter, during fuel cutoff modes of operation.

SUMMARY OF THE INVENTION

It is an object of the present invention to provide a method and system for maintaining acceptable exhaust valve and catalytic converter temperatures during engine fuel cutoff modes of operation.

According to the present invention, a lean operation is scheduled whenever the engine is in a fuel cutoff mode of operation so as to protect the catalytic converter. Additionally, unlike Poirier et al., the present invention contemplates utilizing a completely independent air/fuel schedule versus speed and load. Since only the number of cylinders to be cut off is important, and not necessarily which individual cylinders are cut off, the particular cylinder(s) that are actually cut off continuously changes in an indexed cylinder firing pattern. As a result, for those cylinder events where fresh air is flowing through one or more cylinders, the associated exhaust valves experience a cooling effect. Of course, when the same cylinders are firing, there is an associated heating effect having the potential to exceed exhaust valve temperature limits. However, since the cylinders are continuously fueled and skipped several times per second, the temperatures of the exhaust valves tend to experience an average temperature that is well within the maximum allowable exhaust valve temperatures.

In carrying out this objective and other objectives and features of the present invention, there is provided a method, for use with a vehicle including a multi-cylinder internal combustion engine having exhaust valves, for controlling the temperature of the exhaust valves during fuel cutoff modes of engine operation. The method comprises cutting off the fuel delivered to the cylinders in an indexed cylinder firing pattern to change which cylinders receive fuel, so as to maintain acceptable exhaust valve temperature levels. The method also comprises operating the engine with a lean air/fuel ratio, so as to maintain acceptable catalytic converter temperature levels.

In the preferred embodiment for the method of the invention, the fuel is cut by indexing the cylinder firing pattern during operation at high engine speeds. Each particular combination of fueled and unfueled cylinders is maintained for a predetermined period of time prior to the selection of a new combination. The duration of the predetermined period of time is based on one or more engine characteristics such as the number of the engine cylinders, engine coolant temperature and cylinder wall wetting. The particular combination of fueled and unfueled cylinders is determined utilizing a predetermined base bit pattern.

A system is also provided for carrying out the method.

The advantages of the invention are numerous. For example, the lean air/fuel ratio lowers the exhaust catalytic converter temperatures below the maximum level to avoid damage, and the indexed cylinder firing pattern cutoff strategy utilizes the fresh air flow to cool the engine exhaust valves to acceptable temperature levels even during lean air/fuel ratio engine operation at high speeds and at high loads.

The above object and other objects, features and advantages of the present invention will readily be appreciated by one of ordinary skill in the art from the following detailed description of the best mode for carrying out the invention when taken in connection with the accompanying drawings.

BEST MODE FOR CARRYING OUT THE INVENTION

Figure 1:
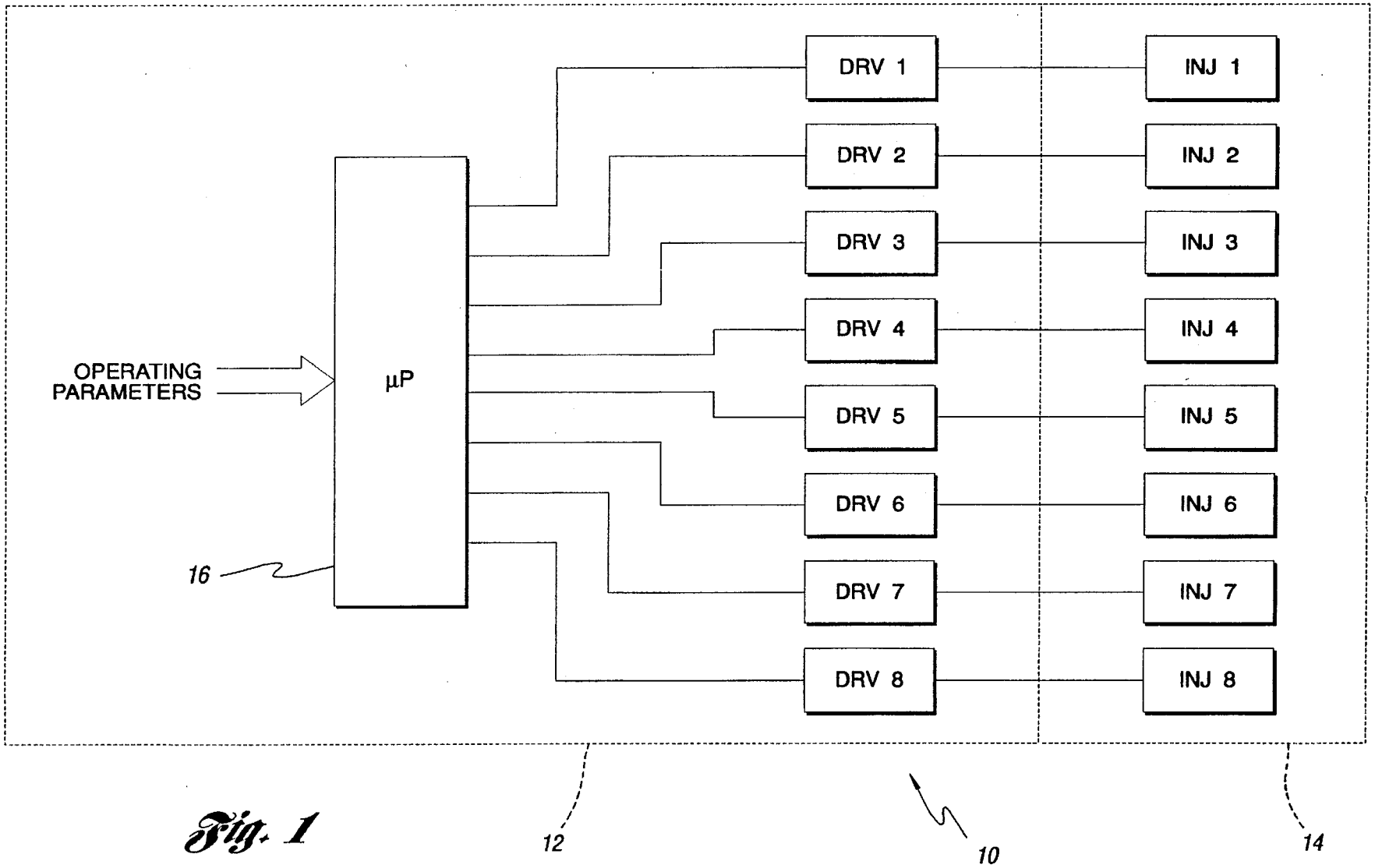
FIG. 1 is a block diagram representation of a system for maintaining acceptable exhaust valve and catalytic converter temperatures during engine fuel cutoff modes of operation according to the present invention.

Referring now to FIG. 1, there is shown a block diagram representation of a vehicle system, shown generally by reference numeral 10, including an electronic control unit (ECU) 12 having a microprocessor 16 for controlling a spark-ignited, internal combustion engine 14. The system operates according to the present invention to maintain acceptable exhaust valve and catalytic converter temperatures during engine fuel cutoff modes of operation.

As is known, the microprocessor 16 has both volatile and nonvolatile memories, such as a keep-alive memory and ROM, associated therewith, and the ECU 12 could also include additional memories separate from and external to the microprocessor 16. During vehicle operation, the microprocessor executes software typically stored in nonvolatile memory, continually gathering in a real-time fashion a plurality of both vehicle and engine operating parameters from well known sensors (not specifically illustrated for the sake of clarity) for purposes of control. These parameters include, but are not limited to, mass air flow, engine speed, coolant temperature, exhaust gas oxygen, vehicle speed, and throttle position.

Utilizing the sensed data, the microprocessor controls various aspects of both vehicle and engine operation. For example, the microprocessor 16 could control the engine combustion process by controlling spark timing and fuel delivery. As shown in FIG. 1, the microprocessor 16 is in electrical communication with a plurality of driver circuits (DRV 1 . . . DRV 8), which are standard fuel injector driver circuits. The driver circuits in turn are in communication with associated fuel injectors (INJ 1 . . . INJ 8), which provide fuel to the combustion cylinders in response to a pulse width modulated voltage determined by the microprocessor based on the operating parameters. Although this discussion refers to an eight cylinder engine, the present invention is equally applicable to many other engine configurations, such as four or six cylinder engines, for example.

While in some instances, it is desirable to increase the amount of fuel provided to the combustion cylinders, in some instances it is desirable to not only reduce, but entirely eliminate, fuel delivery to one or more cylinders. For example, the microprocessor could decide to cutoff fuel delivery upon detecting an engine overspeed condition or a vehicle overspeed condition. Fuel cutoff could also result from detection of a partial or full ignition system failure on a subset of cylinders.

A need for a reduction in the engine torque is yet still another situation in which the microprocessor could command the engine to a fuel cutoff mode of operation. One example of a need for engine torque reduction is in the case of traction control or anti-wheel spin control, wherein one or more of the vehicle tires has lost traction with the road surface. Many times, traction can be regained quickly by reducing the engine torque, thereby reducing the torque delivered to the wheels through the drivetrain. One of ordinary skill in the art could certainly think of other situations, to which the present invention may be applied, which require in a broader sense a need for fuel cutoff and in a narrower sense a need for a reduction of engine torque.

Existing fuel cutoff strategies typically include running the fueled cylinders with an air/fuel ratio leaner than the stoichiometric ratio, which is about 14.7 for U.S. gasolines. However, although this strategy protects the catalytic converter by reducing the quantity of unburned fuel products in the converter, the maximum operating temperatures of the engine exhaust valves can be exceeded with this lean air/fuel ratio, especially during engine operation at high speed and/or loads.

The present invention solves this problem by implementing a strategy which utilizes a bit pattern to continuously rotate which particular cylinders are fueled. Example bit patterns for an eight cylinder engine application are shown below in Table I:

TABLE I

| INJ_SEQ | 8 | 7 | 6 | 5 | 4 | 3 | 2 | 1 | |
|---|---|---|---|---|---|---|---|---|---|
| INJECTOR NUMBER | [8] | [4] | [5] | [6] | [2] | [7] | [3] | [1] | |
| bit position value: | 128 | 64 | 32 | 16 | 8 | 4 | 2 | 1 | |
| MAPS | | | | | | | | | BASE BIT |
| INJ_ON = 8 | 0 | 0 | 0 | 0 | 0 | 0 | 0 | 0 | |
| INJ_ON = 7 | 0 | 0 | 0 | 0 | 0 | 0 | 0 | 1 | = INJ_1OFF = 1 |
| INJ_ON = 6 | 0 | 0 | 0 | 1 | 0 | 0 | 0 | 1 | = INJ_2OFF = 17 |
| INJ_ON = 5 | 0 | 0 | 0 | 1 | 0 | 1 | 0 | 1 | = INJ_3OFF = 22 |
| INJ_ON = 4 | 0 | 1 | 0 | 1 | 0 | 1 | 0 | 1 | = INJ_4OFF = 85 |
| INJ_ON = 3 | 0 | 1 | 1 | 1 | 0 | 1 | 0 | 1 | = INJ_5OFF = 117 |
| INJ_ON = 2 | 0 | 1 | 1 | 1 | 0 | 1 | 1 | 1 | = INJ_6OFF = 119 |
| INJ_ON = 1 | 0 | 1 | 1 | 1 | 1 | 1 | 1 | 1 | = INJ_7OFF = 127 |
| INJ_ON = 0 | 1 | 1 | 1 | 1 | 1 | 1 | 1 | 1 | = INJ_8OFF = 127 |

The cylinder firing number is a crank angle based counter in the foreground that is synchronized by a missing tooth event. Injector number is stored in the nonvolatile memory as a lookup table which, when given a firing order number, outputs which actual injector number corresponds to the sequence number. For any desired number of cylinders to be turned off or left on (INJ_ON), a memory value exists containing the associated bit pattern. This bit pattern, as shown above, is a series of zeros and ones, with "0" indicating the cylinder is to receive fuel, and "1" indicating the cylinder to be cut off from fuel. Table I shows that if 2 cylinders are to be turned off, the value of INJ_2OFF=17. The associated bit pattern equals 00010001. Thus, the first and fifth cylinder in the firing order, or cylinders 1 and 6, will be turned off. With the bit map methodology of the present invention, one can control exactly which cylinders in the firing order are deactivated for each desired number of cylinders off, and therefore achieve optimal engine balance and NVH characteristics. All of this is achieved with minimal computer memory and execution time.

Deactivating fuel injectors is done in a specific order depending on how many injectors are requested to be fueled. Generally, the highest frequency is desired for cutting off fuel to the injectors (i.e. 1 off, 1 on, 1 off, etc., rather than 4 off, 4 on). Once an injector is deactivated, it may be desirable to keep that injector off to minimize transient fuel effects. However, keeping an injector off for long durations may have adverse effects on individual cylinder valve temperatures, but too frequent enablement/disablement may result in excess unburnt fuel being directed to the exhaust, possibly causing catalyst midbed temperatures to rise.

To avoid a possible exhaust valve overtemp condition, the logic implemented allows the cylinder cutoff pattern to be rotated to ensure that all cylinders are equally cooled. More specifically, after a certain number of cylinder events, a bit pattern, representing the fueled and unfueled cylinders, is shifted to the left. This shifting is conducted in the background, thus providing one background loop resolution on pattern rotation. The duration of holding each pattern is calibratable, and is scaled to the number of cylinders in the engine. A calibratable switch is also provided to enable or disable the indexed cylinder firing pattern for cylinder cutoff.

Referring now to FIG. 2, there is shown a flowchart detailing the steps for maintaining acceptable exhaust valve and catalytic converter temperatures during engine fuel cutoff modes of operation. The software executed by the microprocessor is structured such that a portion of the code is executed in the foreground (with respect to the crankangle rotation), and a portion is executed once every background loop.

Figure 2A:
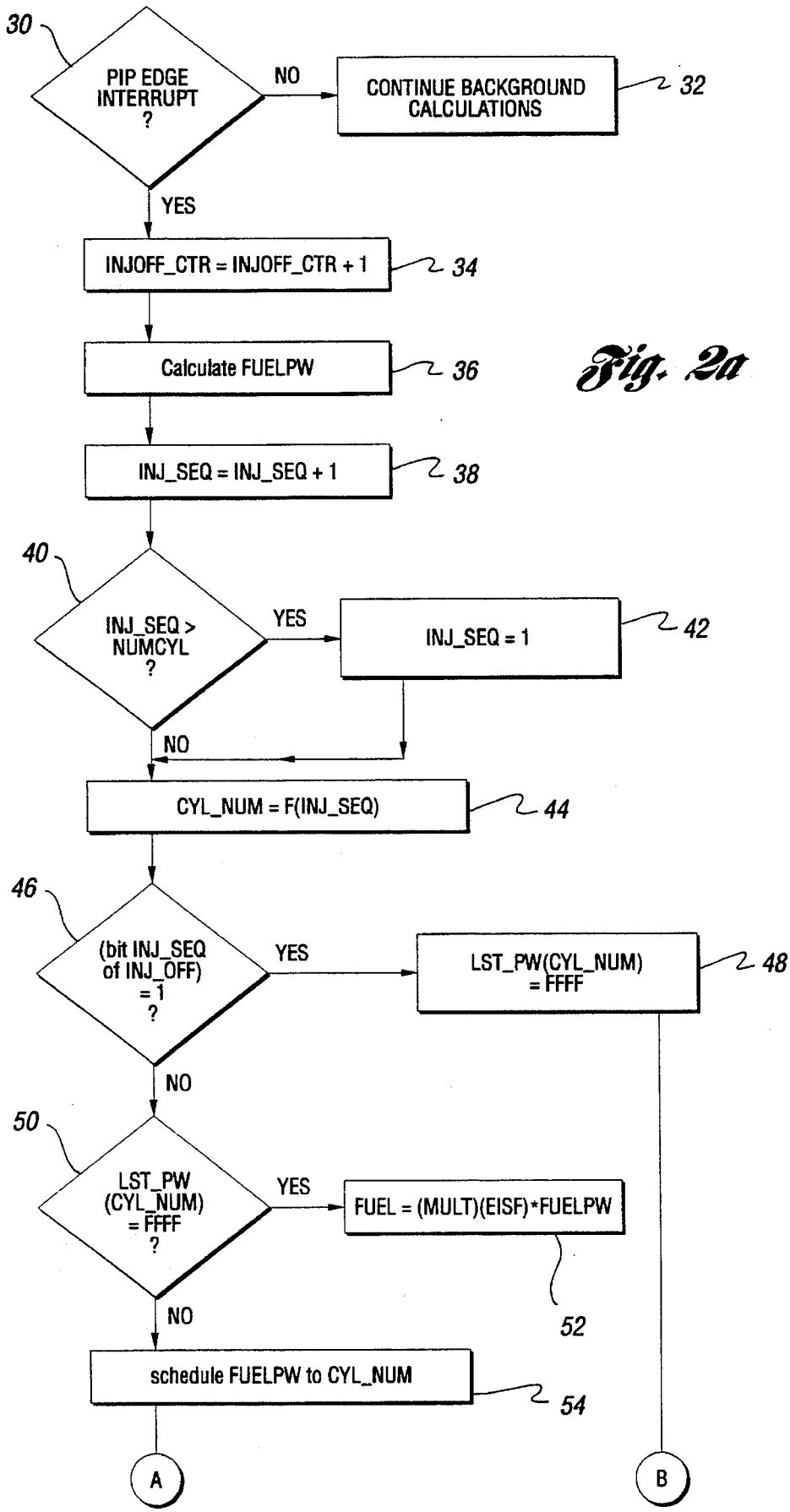
FIGS. 2*a*–2*b* are a flowchart detailing the methodology of the present invention for maintaining acceptable exhaust valve and catalytic converter temperatures during engine fuel cutoff modes of operation.

As shown in FIG. 2*a*, at step 30 the microprocessor determines whether or not it has received a profile ignition pulse (PIP) interrupt signal from the vehicular ignition system. The PIP signal is generated by an engine crankshaft angle sensing system known in the art, which includes a multitoothed wheel. The teeth are spaced about the periphery of the wheel in predetermined angular spacing.

In the preferred embodiment, the wheel is a 36-toothed wheel with one missing tooth (35 teeth). Given 360° degrees for the wheel, each tooth position gives a 10° resolution. An eight (8) cylinder engine is setup to produce a PIP edge every 8 teeth (i.e. 8/720°), whereas a six (6) cylinder engine produces a PIP edge every 6 teeth (i.e. 6/720°), and a four (4) cylinder engine produces a PIP edge every 4 teeth (4/720°). The wheel rotates with the crankshaft or camshaft of the engine, and an appropriate sensor, such as a variable reluctance or Hall-effect sensor, detects the position and speed of the crankshaft. A missing tooth location is provided on the wheel for providing an absolute location reference, such as top dead center of a particular cylinder, by the detection of a time between tooth pulses which is substantially longer than the average time between pulses. As the teeth pass the sensor, a signal is generated which is then processed by the microprocessor to obtain the PIP interrupt signal.

Figure 2B:
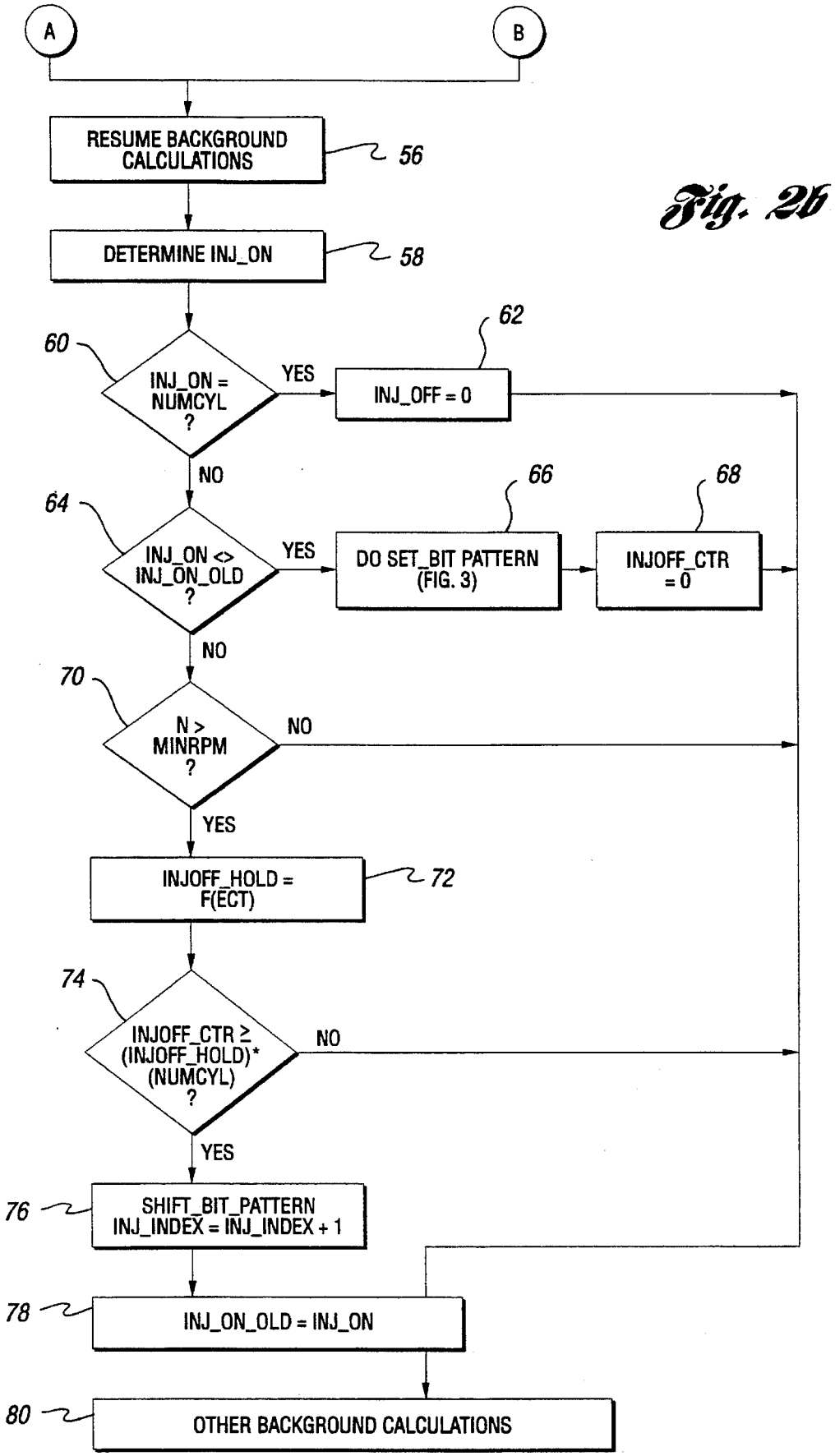

With continuing reference to FIGS. 2*a*–2*b*, if no PIP edge is detected, at step 32, the microprocessor continues background calculations. When the microprocessor 16 receives a PIP edge at step 30, the microprocessor performs a number of foreground calculations for the next cylinder, including calculating air measurement fuel scheduling. First, the microprocessor performs a unit increment of a counter (INJOFF_CTR) at step 34. The INJOFF_CTR is a random access memory (RAM) counter used to control the number of cylinder firing events spent in each cylinder cutoff pattern. At step 36, the microprocessor determines the fuel pulse width (the fuel mass per intake versus airflow and other variables), as is known in the art.

As shown in FIG. 2*a*, at step 38 variable INJ_SEQ is incremented by one. INJ_SEQ is a parameter which represents the firing order number, and allows the microprocessor to keep track of which of the cylinders are to be scheduled for fuel. At step 40, INJ_SEQ is compared to the variable NUMCYL, a calibration read only memory (ROM) value representing the number of cylinders in the engine (i.e. NUMCYL=8 for an eight cylinder engine). The counter INJ_SEQ should not have a value which exceeds the value of NUMCYL, and if it does, INJ_SEQ is set to "1" at step 42. The value of CYL_NUM, a variable representing the actual cylinder to be fired, is obtained at step 44 from a lookup table as a function of INJ_SEQ.

FIG. 2*a* illustrates that at step 46, a bit test is performed on INJ_OFF, a RAM register holding the current bit pattern of cylinders to be cut off. If the bit number of INJ_OFF represented by the value of INJ_SEQ is "1", control flow skips to step 48, wherein the variable LST_PW for that cylinder number (CYL_NUM) is set to "FFFF" hexadecimal, to indicate that fueling of that cylinder was skipped last injection. Determining if a cylinder received a fuel injection event last engine cycle, it is possible to prevent dynamic fuel pulses to cylinders which had no main pulse on the current engine cycle.

If the bit test at step 46 fails, at step 50 the value of LST_PW(CYL_NUM) is evaluated to determine whether fueling of that cylinder was skipped during the last injection. If fueling was skipped, the fuel pulse needs to be adjusted, since the manifold and combustion cylinder walls store a certain amount of fuel (termed wall wetting). As such, some of the injected fuel is lost to the manifold and walls. To reduce the chance of a lean air/fuel spike and maybe a cylinder misfire, the present invention adjusts the fuel pulse. If it is assumed that the actual intake surface fuel mass (AISF) puddle depletes rapidly when a cylinder is not fueled for one or more engine cycles, then the mass of fuel which must be added to replenish a dry cylinder's puddle should be approximately the equilibrium intake surface fuel mass per cylinder (EISF). Preferably, the fuel pulse is adjusted at step 52 to provide a transient fueling utilizing a calibratable number (MULT), which has value greater than one. The new LST_PW should not include the replenishment pulse to provide the proper reference base for dynamic fuel for cylinder x for this pulse.

With continuing reference to FIGS. 2*a*–2*b*, at step 54 the microprocessor schedules the fuel pulse width (FUELPW) to the appropriate cylinder (CYL_NUM). At step 56, background loop calculations are resumed, and may include powertrain control calculations. The remainder of the steps shown in FIGS. 2*a*–2*b* are preferably performed once every background loop.

As shown in FIG. 2*b*, at step 58 the microprocessor determines the value of INJ_ON. This value, which is stored in RAM, represents the number of cylinders (or injectors) desired to be turned on and is determined based on a calculation of maximum allowable torque, as described in greater detail in U.S. patent application Ser. No. 08/270,963, filed Jul. 5, 1994, assigned to the assignee of the present invention, which is hereby expressly incorporated by reference in its entirety.

With continuing reference to FIG. 2*b*, at step 60 the microprocessor compares INJ_ON to NUMCYL. If all the cylinders are to receive fuel (INJ_ON=NUMCYL), at step 62 the microprocessor sets the value of INJ_OFF to zero. At step 64, the microprocessor compares the value of INJ_ON to the value of INJ_ON_OLD, which is a RAM register which holds the previous value of INJ_ON. Thus, the microprocessor determines whether or not the number of cylinders to be provided with fuel has changed. If INJ_ON is less than or greater than INJ_ON_OLD, there has been a change, and control flow skips to step 66, wherein the microprocessor executes the SET_BIT_PATTERN subroutine, the flowchart of which is shown in FIG. 3.

Figure 3:
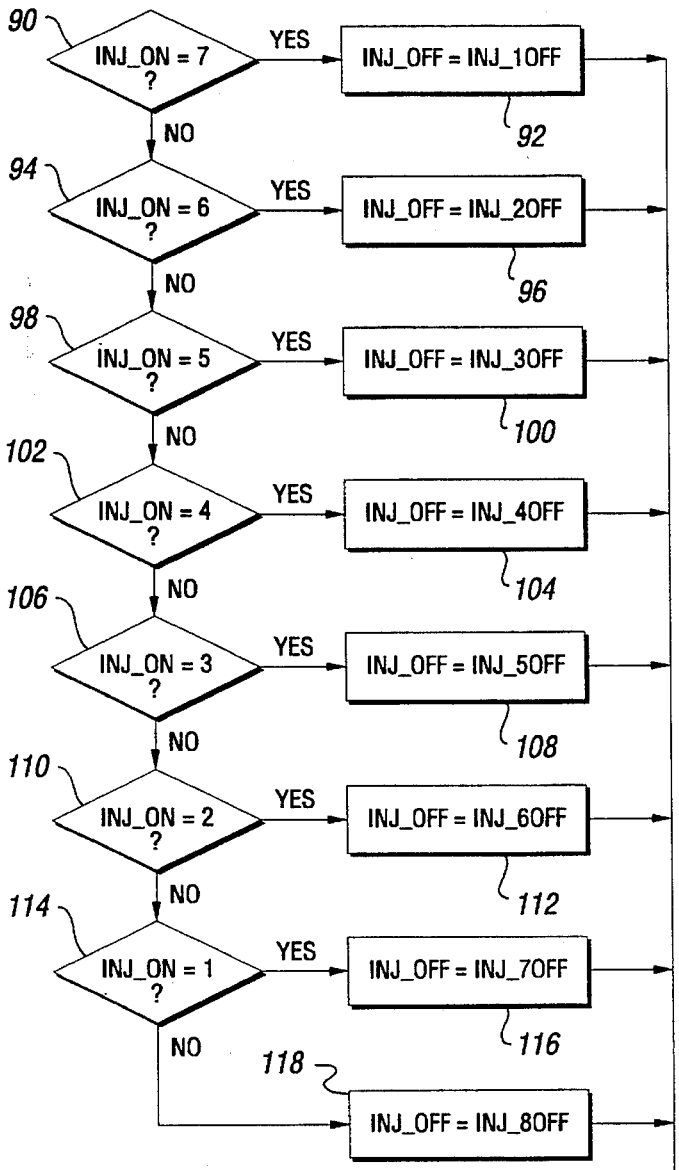
FIG. 3 is a flowchart detailing the methodology of the SET_BIT_PATTERN subroutine, according to the present invention, shown in FIGS. 2*a*–2*b.

Referring now to FIG. 3, the SET_BIT_ PATTERN subroutine is a series of tests (steps 90, 94, 98, 102, 106, 110, and 114) which compare the value of INJ_ON to integers (7, 6, 5, 4, 3, 2, and 1, respectively). Based on the comparisons, the value of INJ_OFF is set to the appropriate bit pattern (steps 92, 96, 100, 104, 108, 112, and 116). For example, if at step 90 the microprocessor determines that INJ_ON has a value of seven (7), then at step 92, INJ_OFF is assigned the value of INJ_1OFF, a calibratable value which indicates the desired bit pattern for cutting off seven (7) cylinders.

As shown in FIG. 3, if the control flow has proceeded to step 114 and that test also fails (i.e. INJ_ON≠0), then control flow proceeds to step 118, since INJ_ON must be equal to zero. Accordingly, at step 118, the microprocessor sets INJ_OFF to INJ_8OFF, which will cut off the fuel to all eight cylinders. At step 120, the variable INJ_ON_OLD is compared to NUM_CYL. If the values of the variables are not equal, this implies the initial fuel cutoff has occurred. The first time the fuel to one or more of the cylinders is cut off, it is desirable to shift the bit pattern to catch (i.e. turn off) the very next cylinder, so as to improve response. If INJ_ON_OLD is equal to NUM_CYL, at step 122 the RAM variable INJ_INDEX, which represents the current cylinder being serviced, is set to the value of "INJ_SEQ+1". At step 124, a do-loop is entered wherein the procedure SHIFT_BIT_PATTERN is executed. At the end of the do-loop, at step 126 of FIG. 3, control flow returns to step 68 of FIG. 2*b*, at which point the microprocessor initializes the INJOFF_CTR to zero. Thereafter, control flow skips to step 78, and the variable INJ_ON_OLD is set to the value of INJ_ON.

As shown in FIG. 2*b*, if the microprocessor had determined that INJ_ON=INJ_ON_OLD at step 64, at step 70 the microprocessor compares the sensed engine speed (N) to MINRPM, the minimum engine speed required for implementation of the indexed cylinder firing pattern of the present invention. In one embodiment, the value of MINRPM is set at 2000. Generally, for engine speeds below this value, exhaust valve temperature limits are not exceeded during lean operation. As such, the indexed firing pattern scheme is not required.

Steps 72 and 74 cooperate to implement a dwell or pause period in the indexed firing pattern scheme. The preferred embodiment includes a pause period since there are certain problems, discussed above, associated with providing fuel to a dry cylinder. In the preferred embodiment, this "dwell period" is a function of engine coolant temperature since temperature greatly impacts the amount of fuel that can be stored on the metal surfaces.

There is a converse problem when a cylinder is first cut off, in that the cylinder walls will take a couple of cylinder events to dry off. Typically, this fuel does not ignite in the cylinder and will ultimately end up burning in the catalyst. Both of these associated problems are mitigated by running each cylinder pattern for a calibratable number of cylinder events before proceeding to the next cylinder pattern.

With continuing reference to FIG. 2*b*, the microprocessor determines the value of INJOFF_HOLD at step 72. INJOFF_HOLD is a variable utilized to represent the number of PIPs per cylinder to hold the current bit pattern. Restated, after INJOFF_HOLD number of engine events (e.g. 2 crank rotations), the bit pattern is rotated left one bit. The value of INJOFF_HOLD is a function of the engine coolant temperature and, more specifically, a function of cylinder wall wetting. In the preferred embodiment, INJOFF_HOLD is a predetermined calibration constant. INJOFF_HOLD should be short enough to provide cooling, and long enough to minimize transient fueling effect of rotating disabled cylinders.

At step 74 of FIG. 2*b*, the microprocessor compares INJOFF_CTR to the quantity INJOFF_HOLD multiplied by NUMCYL. In this way, INJOFF_HOLD works with INJOFF_CTR to pause the indexed firing pattern algorithm at a given bit pattern, as described above. If the condition is not satisfied, the current fuel cutoff pattern will be continued and control flow skips to step 78. If, however, the condition is satisfied, at step 76 INJ_INDEX is incremented and the indexed firing pattern scheme is implemented by altering the bit pattern used to determine which cylinders are fueled.

Figure 4:
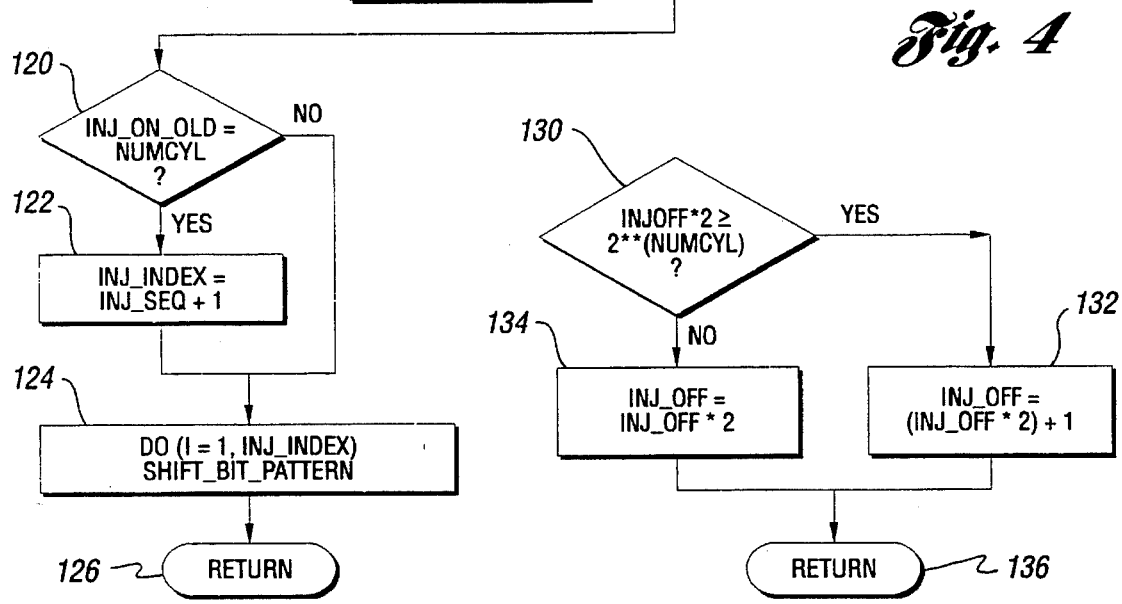
* and FIG. 4 is a flowchart detailing the methodology of the SHIFT_BIT_PATTERN subroutine, according to the present invention, shown in FIGS. 2*a*–2*b*.

The round-robin scheme is illustrated in FIG. 4. At step 130, twice the value of INJOFF is compared to the quantity "2nd (NUMCYL)". If the test is satisfied, at step 132 the microprocessor performs the following:

$$INJ_OFF=(INJ_OFF*2)+1 \quad (1)$$

whereas if the test is not satisfied, at step 134 the microprocessor performs the following:

$$INJ_OFF=INJ_OFF*2 \quad (2)$$

Thus, steps 130–134 implement the round-robin technique of the present invention. The strategy is based in part on the fact that our familiar base ten numbers are stored in a computer in binary. For example, assume INJ_OFF=INJ_2OFF=17 from Table I above. To convert this base ten number to binary, the number "17" should be rewritten in terms of "powers of 2". That is, $17=2^4+2^0=16+1$. As is known, a computer byte consists of eight individual bit positions. The binary bit pattern corresponding to "17" is 00010001, where the leftmost 1 represents $2^4$ and the rightmost 1 represents $2^0$. Referring to the data shown in Table I above, when INJ_OFF=INJ_2OFF, injectors "1" and "6" will be deactivated and cylinders "1" and "6" will no longer be fueled.

In the preferred embodiment, the indexed firing pattern technique involves a shifting of the bits to the left, as shown in steps 132 and 134. For example, assume INJ_OFF=17. After step 134, INJ_OFF=INJ_OFF*2, yielding 2*17=34. Expressed in base two, decimal "34" can be rewritten as $2^5+2^1=32+2$, and the corresponding binary bit pattern is 00100010. Thus, the bit patterns for "$17_{10}$" and "$34_{10}$" are both symmetrical, and are similar in that the same number of cylinders are not being fueled. The bit patterns are different, however, in that the cylinders that are no longer being fueled has changed. Thus, the process of multiplying INJ_OFF times two gives us the desired round-robin effect.

By performing step 130 of FIG. 4, the present invention accounts for the fact that after INJ_OFF is shifted (i.e. multiplied by 2), the leftmost bit will be lost since the greatest number that can be represented by eight bits is "255". Accordingly, the "lost" bit is replaced on the rightmost side by adding 1 at step 132.

As shown in FIG. 4, at step 136 control flow returns to step 78 of FIG. 2*b*, at which the microprocessor sets the value of INJ_ON_OLD to the current value of INJ_ON. At step 80, any other background calculations, such as for powertrain control, could be performed as required.

Tables II and III below illustrate example bit patterns for four and six cylinder engine applications, respectively. By modifying the variable INJ_OFF, different engine applications are possible. For example, by expanding the variable INJ_OFF to a word instead of a byte, a sixteen cylinder engine application is possible.

TABLE II

| INJ_SEQ | | 6 | 5 | 4 | 3 | 2 | 1 | |
|---|---|---|---|---|---|---|---|---|
| Injector Number | | [5] | [6] | [2] | [4] | [3] | [1] | |
| bit position value: | | 32 | 16 | 8 | 4 | 2 | 1 | |
| MAPS | | | | | | | | BASE BIT |
| INJ_ON = 6 | x x | 0 | 0 | 0 | 0 | 0 | 0 | |
| INJ_ON = 5 | x x | 0 | 0 | 0 | 0 | 0 | 1 | = INJ_1OFF = 1 |
| INJ_ON = 4 | x x | 0 | 0 | 1 | 0 | 0 | 1 | = INJ_2OFF = 9 |
| INJ_ON = 3 | x x | 0 | 0 | 1 | 0 | 1 | 1 | = INJ_3OFF = 11 |
| INJ_ON = 2 | x x | 0 | 1 | 1 | 0 | 1 | 1 | = INJ_4OFF = 27 |
| INJ_ON = 1 | x x | 0 | 1 | 1 | 1 | 1 | 1 | = INJ_5OFF = 31 |
| INJ_ON = 0 | x x | 1 | 1 | 1 | 1 | 1 | 1 | = INJ_6OFF = 63 |

(0 = ON) (1 = OFF)

TABLE III

| INJ_SEQ | | 4 | 3 | 2 | 1 | | | | |
|---|---|---|---|---|---|---|---|---|---|
| Injector Number | | [4] | [2] | [3] | [1] | | | | |
| bit position value: | | 8 | 4 | 2 | 1 | | | | |
| MAPS | | | | | | | | | BASE BIT |
| INJ_ON = 4 | x x x x | 0 | 0 | 0 | 0 | | | | |
| INJ_ON = 3 | x x x x | 0 | 0 | 0 | 1 | | | | = INJ_1OFF = 1 |
| INJ_ON = 2 | x x x x | 0 | 1 | 0 | 1 | | | | = INJ_2OFF = 5 |
| INJ_ON = 1 | x x x x | 0 | 1 | 1 | 1 | | | | = INJ_3OFF = 7 |
| INJ_ON = 0 | x x x x | 1 | 1 | 1 | 1 | | | | = INJ_4OFF = 15 |

(0 = ON) (1 = OFF)

As illustrated by Tables I, II and III above, the cutout patterns for disabling different numbers are designed so that their base configurations each have a cutout cylinder in the same location. Each successive pattern is a superset of the pattern with one less cylinder cutout. To ensure the fastest possible engine response to an initial torque limitation request, the strategy identifies the next cylinder which is scheduled to be fueled; or if possible, a fuel event that has been scheduled but has not yet begun. This fuel event is then canceled. The cutout pattern is realigned to synchronize the immediate cutout event to a cutout request in the pattern, and normal cutout pattern operation continues using the rotated pattern. A pattern may be rotated from its base value due to initial alignment, as described above, or indexed firing pattern operation. The net resulting rotational transformations are tracked by the software algorithm. When changing to a new cutout pattern, the new base pattern is rotated the same net amount as the pattern that is currently in use, to ensure smoother transition during pattern changes.

In addition, it should be noted that the logic, upon the first request to cut out a cylinder, automatically rotates the cylinder cutout pattern to align a cutout bit with the actual bit in INJ_OFF that foreground fuel will consider on the next PIP interrupt. This logic in effect cuts out the next available cylinder, so it is especially useful for traction control and a more accurate torque calculation. In the instant that the indexed cylinder firing pattern is disabled, and the next cylinder was caught (i.e. the base pattern was rotated), the cutout switch can be used to return the just rotated pattern back to the default pattern.

It is understood, of course, that while the form of the invention herein shown and described constitutes the preferred embodiment of the invention, it is not intended to illustrate all possible forms thereof. It will also be understood that the words used are words of description rather than limitation, and that various changes may be made without departing from the spirit and scope of the invention as disclosed.

We claim:

1. A method, for use with a vehicle powered by an internal combustion engine having multiple power cylinders with intake valves and combustion gas exhaust valves for controlling the temperature of said exhaust valves, said cylinders being fueled in successive firing cycles with predetermined firing patterns, and an electronic digital microprocessor including sets of data storage memory registers defining data bits in a pattern, including a base bit pattern, corresponding to said firing pattern, the method comprising:

storing in separate ones of said memory register sets a plurality of cylinder firing patterns;

cutting off fuel delivered in an indexed cylinder firing pattern whereby fuel is delivered to the fueled cylinders in a separate firing pattern for each successive firing cycle, the number of firing patterns being determined by the number of power cylinders, the firing pattern for each cycle being indexed successively to the next firing pattern after a calibratable time upon completion of one or more firing cycles, whereby acceptable exhaust valve temperatures are maintained;

each combination of fueled and unfueled cylinders being maintained for a predetermined period of time prior to the selection of a new combination of fueled and unfueled cylinders;

said engine having operating characteristics including the number of engine cylinders, engine coolant temperature and cylinder wall wetting, said predetermined period of time being based on at least one of said engine operating characteristics;

the number of bits in said bit pattern being based on the number of engine cylinders;

each combination of fueled and unfueled cylinders utilizing a different bit pattern to identify which cylinders receive fuel, the same bit location in each bit pattern being utilized to identify a common unfueled cylinder.

2. The method of claim 1 including the steps of:

identifying the next scheduled fuel event for a cylinder to be fueled in said firing cycle;

canceling said fuel event; and rotating the bit pattern to synchronize the canceled fuel event with a predetermined bit pattern.

3. The method of claim 1 further comprising:

rotating said base bit pattern to a first new bit pattern representing a first combination of fueled and unfueled cylinders;

rotating said first new bit pattern to a second new bit pattern representing a second combination of fueled and unfueled cylinders; and rotating said base pattern the same amount as the first new bit pattern was rotated.

4. The method of claim 1 further comprising the step of providing transient fuel to each of the cylinders cut off from fuel delivery when the cutoff cylinders begin to receive fuel, so as to replenish the fuel on the walls of the cylinders.

5. A system, for use with a vehicle powered by an internal combustion engine having multiple power cylinders with intake valves and combustion gas exhaust valves adapted to control the temperature of said exhaust valves, said cylinders being fueled in successive firing cycles with a predetermined firing pattern;

an electronic digital microprocessor including sets of data storage memory registers defining data bits in a pattern corresponding to said firing pattern;

said memory register bits being arranged in sets, separate ones of said memory register sets defining a separate cylinder firing pattern;

means for cutting off fuel delivered to at least one of said cylinders in an indexed cylinder firing pattern whereby fuel is delivered to the fueled cylinders in a separate firing pattern for each successive firing cycle, the number of firing patterns being determined by the number of power cylinders and for indexing the firing pattern for each cycle successively to the next firing pattern after a calibratable time upon completion of one or more firing cycles, whereby acceptable exhaust valve temperatures are maintained;

said engine having operating characteristics including the number of engine cylinders, engine coolant temperatures and cylinder wall wetting, said predetermined period of time being based on at least one of said engine operating characteristics;

each combination of fueled and unfueled cylinders utilizing a different bit pattern to identify which cylinders receive fuel, the same bit location in each bit pattern being utilized to identify a common unfueled cylinder.

6. The system of claim 5 further comprising:

means for identifying the next scheduled fuel event for a cylinder to be fueled in said firing cycle or a scheduled uninitiated fuel event;

means for canceling the fuel event; and means for rotating the bit pattern to synchronize the canceled fuel event to a predetermined bit pattern.

7. The system of claim 5 further comprising:

means for rotating the base bit pattern to a first new bit pattern representing a first combination of fueled and unfueled cylinders;

means for rotating the first new bit pattern to a second new bit pattern representing a second combination of fueled and unfueled cylinders; and means for rotating the base pattern the same amount as the first new bit pattern was rotated.

8. The system of claim 5 comprising further means for providing transient fuel to each of the cylinders cut off from fuel delivery when the cutoff cylinders begin to receive fuel, so as to replenish the fuel on the walls of the cylinders.

* * * * *